US005111185A

United States Patent [19]

Kozaki

[11] Patent Number: 5,111,185

[45] Date of Patent: May 5, 1992

[54] PASSWORD CONTROLLED ANTI-THEFT SYSTEM FOR DISCOURAGING THEFT OF A MULTIPLE-APPARATUS SYSTEM

[75] Inventor: Kengo Kozaki, Tokyo, Japan

[73] Assignee: Clarion Co., Ltd., Tokyo, Japan

[21] Appl. No.: 513,771

[22] Filed: Apr. 24, 1990

[30] Foreign Application Priority Data

May 8, 1989 [JP] Japan ..... 1-114861

[51] Int. Cl.[5] ..... G08B 13/22

[52] U.S. Cl. ..... 340/568; 340/571; 340/825.31; 340/825.32; 364/184; 364/185

[58] Field of Search ..... 340/568, 571, 825.31, 340/825.32; 364/184, 185

[56] References Cited

U.S. PATENT DOCUMENTS 4,103,289 7/1978 Kolber ..... 340/571

4,734,896 3/1988 Soma et al. ..... 340/568

4,882,752 11/1989 Lindman et al. ..... 340/825.31

*Primary Examiner*—Glen R. Swann, III

*Attorney, Agent, or Firm*—Frishauf, Holtz, Goodman & Woodward

[57] ABSTRACT

A password anti-theft system for a multiple-apparatuses system, in which a central apparatus has at least one peripheral apparatus connectable thereto. When the peripheral apparatus is connected to the central apparatus, entry of passwords respectively peculiar to the central apparatus and the at least one peripheral apparatus concurrently releases the burglary modes of the central and peripheral apparatuses. When the peripheral apparatus is disconnected from the central apparatus or independent of the password system, entering the peculiar password of the central apparatus only releases the burglary mode of the central apparatus.

14 Claims, 5 Drawing Sheets

PASSWORD CONTROLLED ANTI-THEFT SYSTEM FOR DISCOURAGING THEFT OF A MULTIPLE-APPARATUS SYSTEM

BACKGROUND OF THE INVENTION

1. Field of the Invention

The present invention relates to a password controlled anti-theft system which discourages theft of apparatus of a type in which entering a password sets a burglary mode in apparatus having a normal operation mode (i.e. non-burglary mode) and particularly to a system which sets and releases the burglary modes of multiple apparatuses that are connected to a central apparatus.

2. Description of the Related Art

A prior-art anti-burglar system for in-car electronic apparatus, e.g., a car-audio equipment has been known which is designed so that once the in-car electronic apparatus is removed from a car and disconnected from a backup electric power source, it will not operate even if it is again connected to an electric power source. It will only operate again when a fixed password is entered into the system, whereby the anti-burglar system produces only partial protection of the in-car apparatus.

Such burglar-proof systems operate effectively only when each of in-car electronic apparatuses has an anti-burglar system provided therein that operates independently of the other anti-burglar systems.

However, since an audio system comprising a plurality of apparatuses, e.g., an in-car multi-component stereo system is now being sold which can include C.D.'s, speakers, tape recorders, equalizers, etc., the above-described prior-art system cannot handle this audio system.

For example, in a combination of a radio receiver with a burglar-proof system and an equalizer without a burglar-proof system, releasing a burglar-proof mode of the radio receiver allows the equalizer to be freely available. Thus, the prior-art burglar-proof system has entailed a problem in that it cannot operate for the equalizer.

On the other hand, when peripheral apparatuses have respective burglar-proof system, releasing a burglar-proof mode of each peripheral apparatus by a corresponding unique method has been very complicated and in addition, providing each peripheral apparatus with a burglar-proof system is costly.

SUMMARY OF THE INVENTION

The present invention which was made in order to overcome the prior-art problems provides a password activated anti-theft system for a multiple-apparatus in which a central apparatus has at least one peripheral apparatus connectable thereto and once each of the central and peripheral apparatuses enters into a burglary mode, (i.e. anti-theft mode) that apparatus is inhibited from normal operation until a correct password enters, the password activated system comprising: the central apparatus has a means for entering a password and a peculiar password and controls the peripheral apparatus; the peripheral apparatus has a second peculiar password; when the peripheral apparatus is connected, entering the peculiar passwords of the central apparatus and the peripheral apparatus releases the burglary modes of the central and peripheral apparatuses; and when the peripheral apparatus is disconnected or independent of the central apparatus, entering the peculiar password of the central apparatus releases the burglary mode of only the central apparatus.

DESCRIPTION OF THE PREFERRED EMBODIMENTS

The preferred embodiments of the present invention will be described with reference to FIGS. 1–5 hereinafter.

Figure 1:
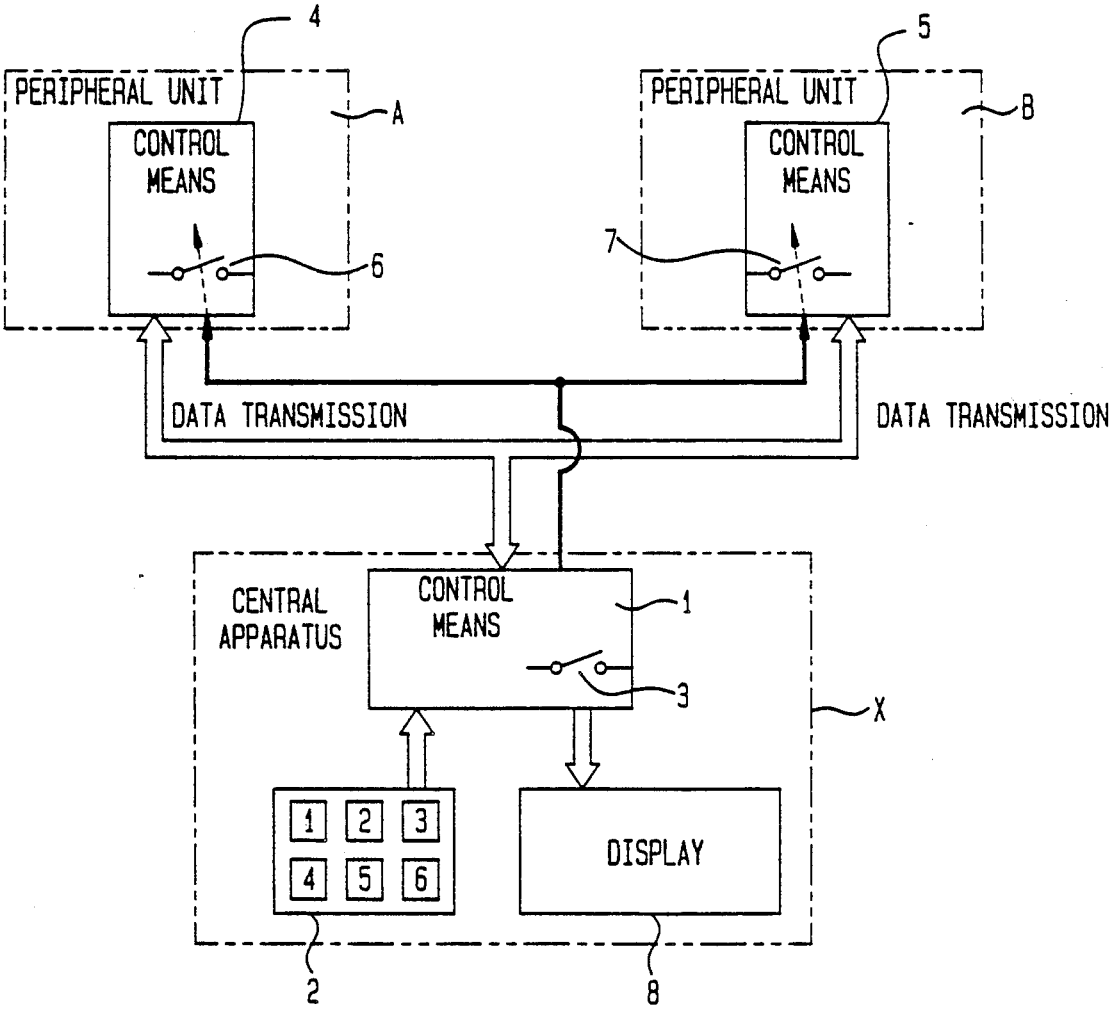
FIG. 1 is a block diagram of a first embodiment of the present invention.

FIG. 1 illustrates a first embodiment of the present invention. A central apparatus (unit) X has two peripheral apparatuses (units) A and B both connectable to the central apparatus X.

The respective central apparatus X and peripheral apparatuses A and B include control means 1, 4 and 5 each comprising a microcomputer. The respective control means 1, 4 and 5 include burglary mode switches 3, 6 and 7 each of which brings a corresponding one of the apparatuses X, A and B into an inoperative position, i.e., burglary mode when the one of the apparatuses X, A and B has been burglarized. Each of the control means 1, 4 and 5 stores a peculiar password releasing the burglary mode thereof.

The control means 1 has an entry means 2 for entering a password and collates the password from the entry means 2 with the peculiar password stored in the control means 1 to turn the burglary mode switch 3 ON when these passwords match each other to release the burglary mode of the central apparatus X. The control means 1 also has a display means 8 connected thereto and presenting various informations as well as the entered password.

The control means 1, 4 and 5 transmit and receive data therebetween. The control means 1 transmits fixed data peculiar to the respective peripheral apparatuses A and B to the control means 4 and 5. That is, the control means 1 transmits fixed data A to the control means 4 and fixed data B to the control means 5.

The respective control means 4 and 5, transmit acknowledge data back to the central means 1 in response to receipt of the respective fixed data A and B. Each of the acknowledge data comprises an identification code of a corresponding peripheral apparatus and the peculiar password for releasing the burglary mode of the corresponding peripheral apparatus. For example, the identification code of the peripheral apparatus A is an A-code which immediately identifies the peripheral apparatus A. The control means 1 identifies a peripheral apparatus in response to receipt of the acknowledge data, receives the peculiar password of the identified peripheral apparatus transmitted concurrently with the acknowledge data and temporarily stores this peculiar password.

The control means 1 collates the peculiar password transmitted from the identified peripheral apparatus with a password entered through the entry means 2 and turns ON a corresponding one of the burglary mode switches 6 and 7 of the peripheral apparatuses A and B when these passwords match each other, to release the burglar mode of an identified one of the peripheral apparatuses A and B.

Figure 2:
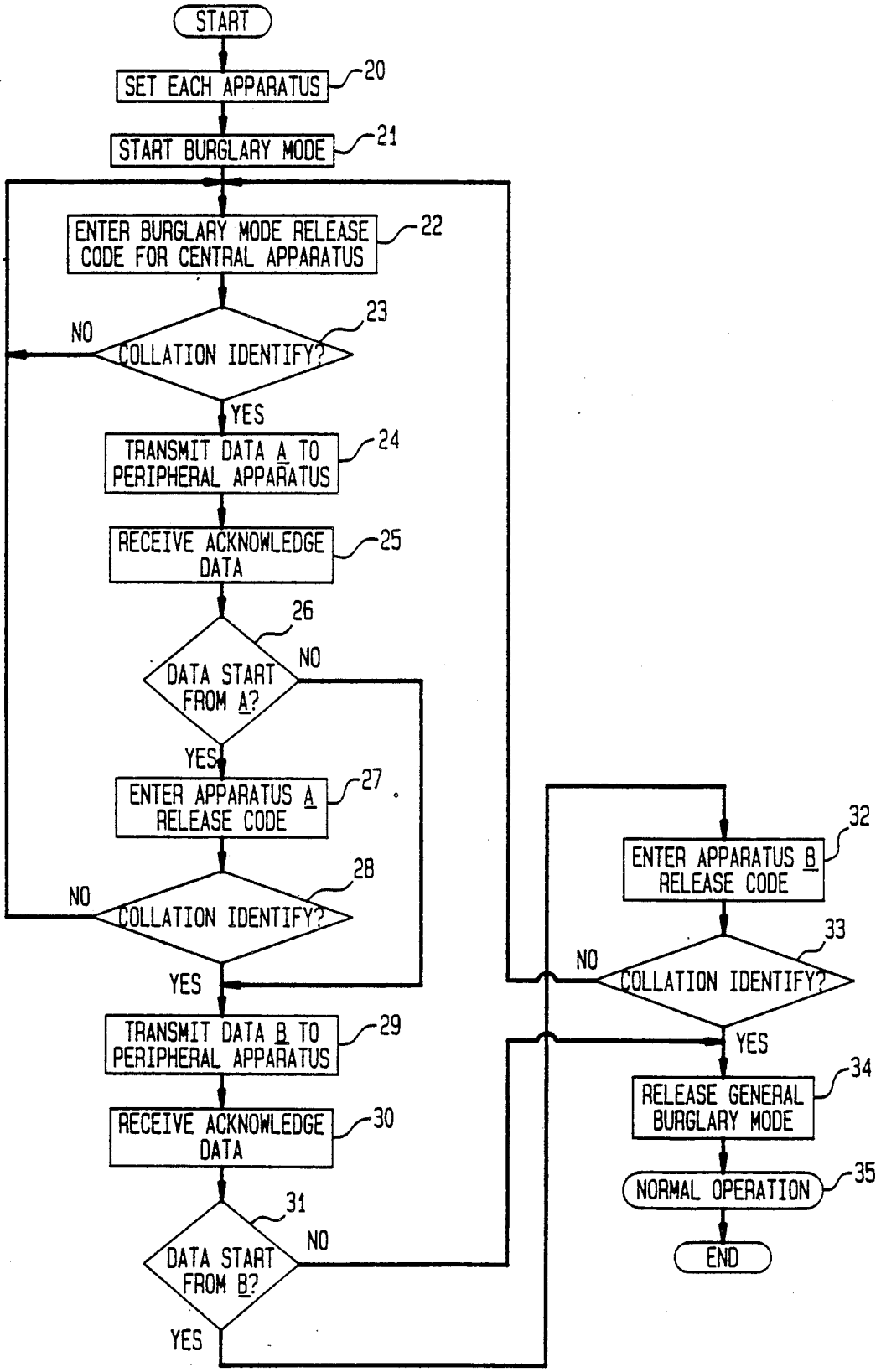
FIG. 2 is a flowchart illustrating the operation of the first embodiment.

The operation of the burglar-proof system of the present invention will be described with reference to FIG. 2 hereinafter. When the central apparatus X and peripheral apparatuses A and B, have been burglarized and disconnected from an electric power connected to an electric power source, the apparatuses X, A and B will not operate since the apparatuses X, A and B have been switched to the burglary modes and the burglary mode switches 3, 6 and 7 are OFF (steps 20 and 21). When a code for releasing the burglary modes of the apparatuses X, A and B is entered through the entry means 2 (step 22), the display means 8 presents this code and the control means 1 collates this code with the peculiar password stored therein (step 23). When this code fails to match the peculiar password of the central apparatus X, the program returns to the step 22.

When this code matches the peculiar password of the central apparatus X, the control means 1 causes the display means 8 to indicate the matching and transmits the fixed data A to the control means 4 and receives the acknowledge data from the control means 4 (steps 24 and 25). When the identification code of this acknowledge data is the A-code (step 26), the control means 1 determines that the peripheral apparatus A is connected and waits for a code entry through the entry means 2 and concurrently causes the display means 8 to indicate a code entry request. When a code is entered through the entry means 2 (step 27), the control means 1 collates the code entered through the entry means 2 with the peculiar password of the acknowledge data from control means 4 in order to determine a matching therebetween (step 28). When this code matches this peculiar password, the program advances to the step 29 and on the other hand, returns to the step 22 when this code fails to match this password. When the identification code is determined to be not the A-code at step 26, the control means 1 determines that the peripheral apparatus A is disconnected and the program skips steps 27 and 28 to step 29.

Then, the control means 1 transmits the fixed data B to the control means 4 and receives the acknowledge data from the control means 5 (steps 29 and 30). When the identification code of this acknowledge data is the B-code (step 31), the control means 1 determines that the peripheral apparatus B is connected, waits for a code entry through the entry means 2 and concurrently causes the display means 8 to indicate a code entry request. When the code is entered through the entry means 2 (step 32), the control means 1 collates the code entered through the entry means 2 with the peculiar password of the acknowledge data from control means 5 in order to determine a matching therebetween (step 33). When this code matches this peculiar password, the program advances to the step 34 and on the other hand, returns to the step 22 when this code fails to match this peculiar password.

Since the control means 1 has confirmed that the respective codes entered through the entry means 2 have matched the peculiar passwords of the central apparatus X and peripheral apparatuses A and B, the control means 1 turns the burglary mode switch 3 ON to release the burglary mode of the central apparatus X and concurrently transmits signals to the respective burglary mode switches 6 and 7 to release the burglary modes of the peripheral apparatuses A and B (step 34). Then, the apparatuses X, A and B return to normal operations (step 35). Since the control means 1 determines at step 31 that the peripheral apparatus B is disconnected when the identification code is not the B-code and the control means 1 has already determined that the peripheral apparatus A is disconnected, the program skips steps 32 and 33 to the step 34 to turn the burglary mode switch 3 ON to release the burglary mode of the central apparatus X.

As described above, the peripheral apparatuses each having the peculiar passwords are connected to the central apparatus X, so that the overall system comprising the apparatuses X, A and B will not operate unless the burglary modes of all of the apparatuses are released. In addition, since the burglary modes of all of the apparatuses can be released centrally at the central apparatus X, the operation of releasing the burglary modes of all of the apparatuses will not be troublesome. On the other hand, when central apparatus X has a peripheral apparatus without password means connected thereto or has no peripheral apparatuses connected thereto, releasing the burglary mode of the central apparatus X allows the central and peripheral apparatuses to normally operate.

Figure 3:
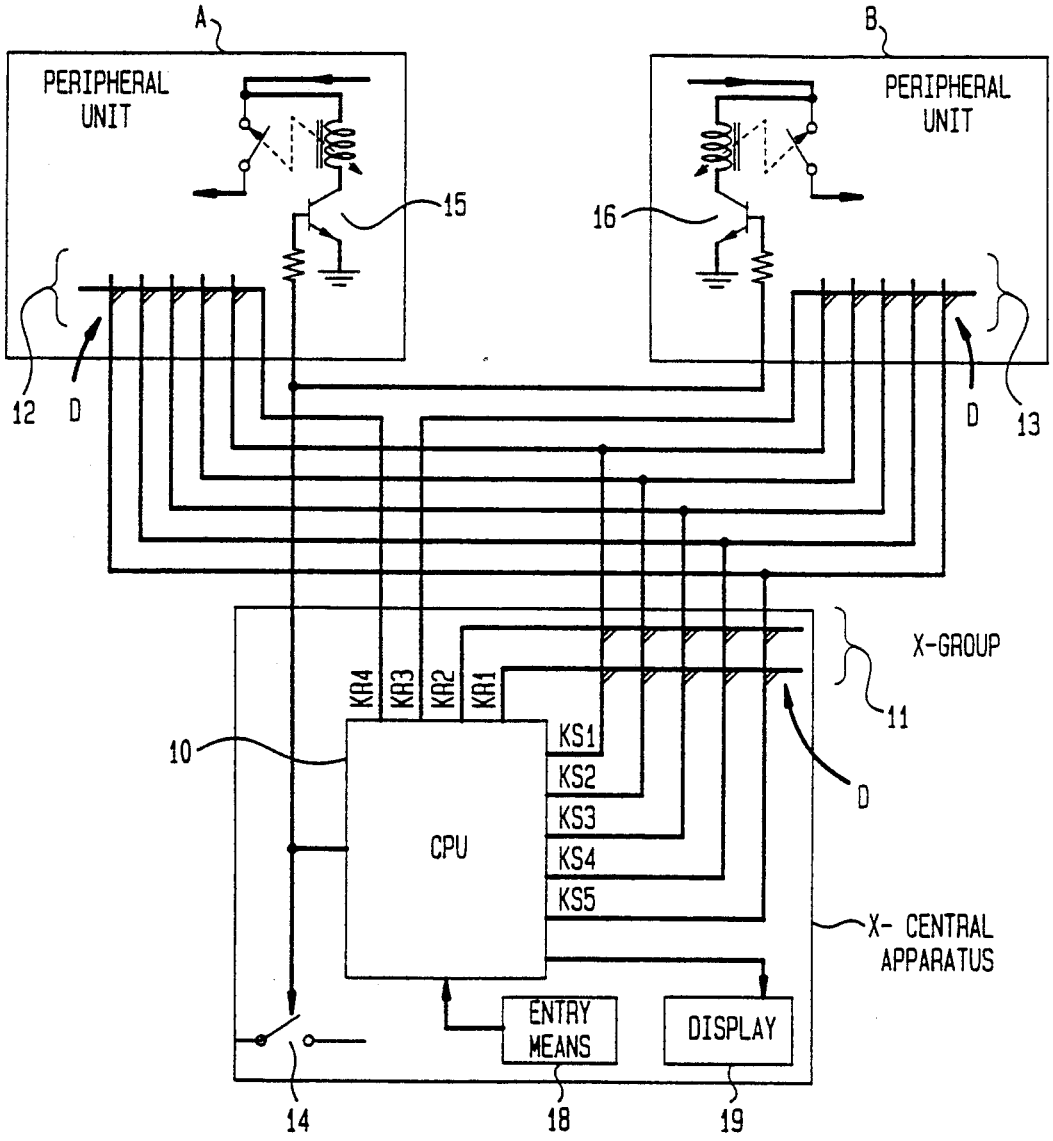
FIG. 3 is a block diagram of a second embodiment of the present invention.
Figure 4:
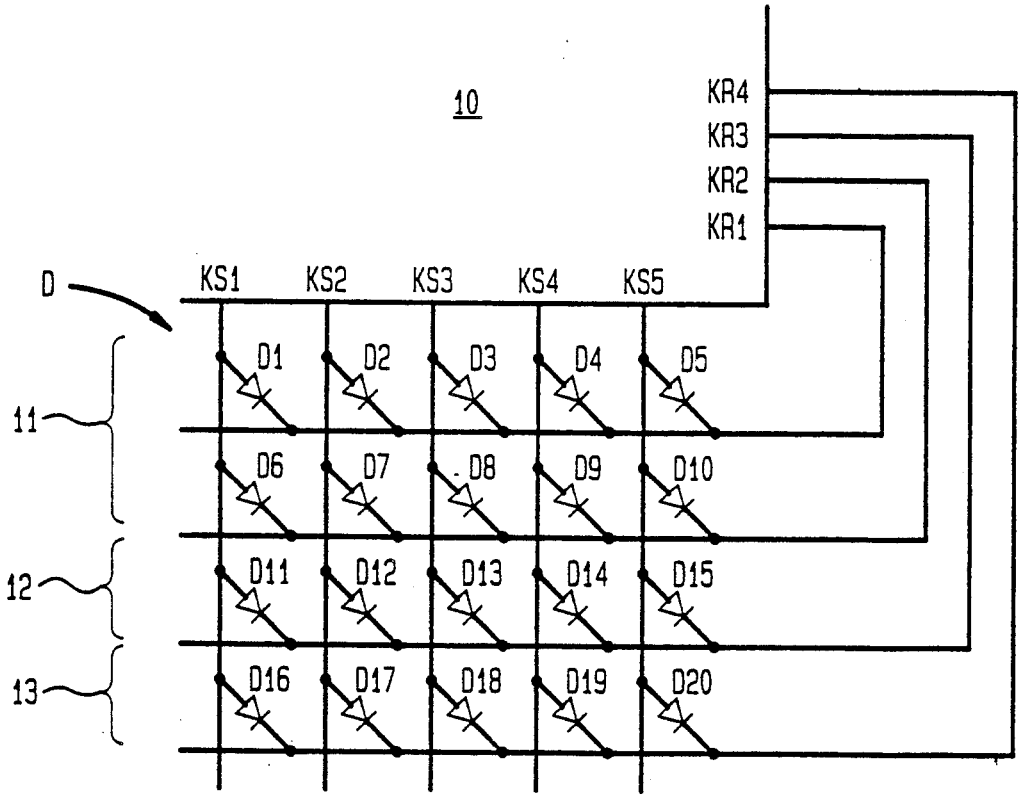
FIG. 4 is a detailed circuit diagram of a diode matrix of FIG. 3.

FIGS. 3 and 4 illustrate a second embodiment of the present invention.

In accordance with the second embodiment, each of peripheral apparatuses includes initializing diode switches instead of a control means such as a CPU, and provides anti-burglar protection of the overall system comprising a central apparatus X and the peripheral apparatuses A and B. The second embodiment includes a diode matrix D connected to a CPU 10 of the central apparatus X. As shown in FIG. 4, the diode matrix D comprises diode switches D1 to D20 providing a 20-bit information. Selecting each of the diode switches D1 to D20 to be ON or off sets peculiar passwords. Diode switches D1 to D10 constitute an X-group of diode switches 11. Diode switches D11 to D15 constitute an A-group of diode switches 12. Diode switches D16 to D20 constitute a B-group of diode switches 13. As shown in FIG. 3, the central apparatus X includes the X-group of diode switches 11, the peripheral apparatus A includes the A-group of diode switches 12, and the peripheral apparatus B includes the B-group of diode switches 13.

The central apparatus X includes an entry means 18, display means 19 and burglary mode switch 14 as in the first embodiment of the present invention. The respective peripheral apparatuses A and B also have burglary mode switches 15 and 16 which are on-off controlled by signals transmitted by the CPU 10 of the central apparatus X. When both the A- and B-groups of diode switches 12 and 13 are OFF, the CPU 10 determines that the peripheral apparatuses A and B are disconnected to release the burglary mode of the central apparatus X in response to only a matching between the password set by means of the X-group of diode switches 11 and a code entered through the entry means 18. On the other hand, when the A-group of diode switches 12 includes one ON diode, both the central apparatus X and peripheral apparatus A are inoperative unless the password of the peripheral apparatus A as well as the password of the central apparatus X is entered. This is the same as of the peripheral apparatus B.

Figure 5:
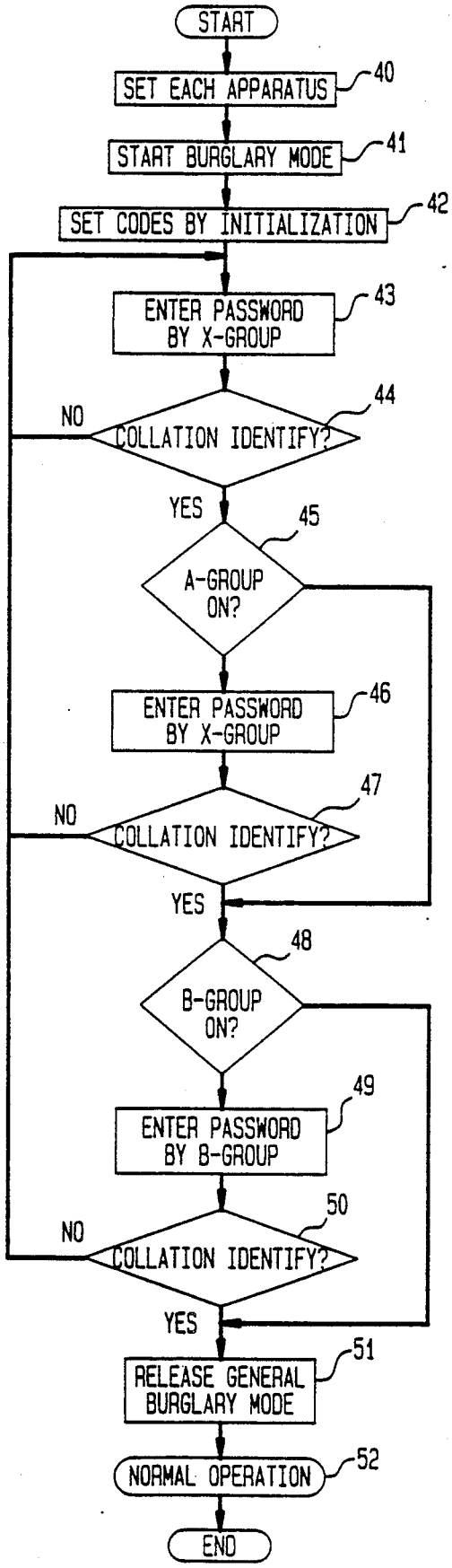
FIG. 5 is a flowchart illustrating the operation of the second embodiment.

The apparatus of the second embodiment will be described with reference to FIG. 5 hereinafter.

The respective apparatuses X, A and B are set (step 40) with an electric power source turned on, they are brought into burglary modes, i.e., inoperative positions (step 41). A combination of the ON-OFFS of the diode switches D1 to D20 of the diode matrix D sets the passwords of the apparatuses X, A and B (step 42). When a code is entered through the entry means 18 (step 43), the CPU 10 collates this entered code with the password set by means of the X-group of diode switches 11 (step 44). When this code fails to match this password, the program returns to step 43. After a correct password, the CPU 10 checks the position of the A-group of diode switches 12 (step 45) and determines the disconnection of the peripheral apparatus A when all of the switches of the A-group of diode switches 12 are OFF, so that the program skips steps 46 and 47 to step 48. When at least one of the A-group of diode switches 12 is on, the CPU 10 waits for a code entry and causes the display means 19 to indicate a code entry request. When a code is entered through the entry means 18 (step 46), the CPU 10 collates this code with the password set by the A-group of diode switches 12 (step 47). When this code fails to match this password, the program returns to step 43. On the other hand, when this code matches this password, the CPU 10 checks the position of the B-group of diode switches 13 (step 48) and determines the disconnection of the peripheral apparatus B when all of the switches of the B-group of diode switches 13 are OFF, so that the program skips steps 49 and 50 to step 51. When at least one of the B-group of diode switches 13 is ON, the CPU 10 waits for a code entry and causes the display means 19 to indicate a code entry request. When a code is entered through the entry means 18 (step 49), the CPU 10 collates this code with the password set by the B-group of diode switches 13 (step 50). When this code fails to match this password, the program returns to step 43. On the other hand, when this code matches this password, the CPU 10 concurrently releases the burglary modes of the central apparatus X and the peripheral apparatuses A and B (step 51) and returns to the normal operation (step 52). Since both the peripheral apparatuses A and B are in the disconnected positions, the CPU 10 releases the burglary mode of the central apparatus X at step 51 when all of the diode switches of the B-group of diode switches 13 are OFF at step 48.

In accordance with the second embodiment of the present invention of FIG. 3, each of the peripheral apparatuses need not have a CPU, which saves on cost.

As described above, when a burglary mode switch of each of central and peripheral apparatuses is in a burglary mode, (i.e., anti-theft mode) the normal operations of the apparatuses are inhibited. Thus, if this apparatus is stolen from a car, it will be worthless since it will not operate until the enabling password is entered. In particular, any system in which a CD-player, tape player and/or the like are disconnected from a main electric power source so that drive mechanisms thereof themselves are brought into inoperative positions can be protected. Similarly, a system in which the main electric power source is in connected position so as to maintain the drive mechanisms in operative positions but however, the transmission of an audio signal picked up from an audio disc or tape is interrupted by theft thereof, protection can still be provided. Each of these systems embodying the present invention can be an effective anti-burglary-proof system.

What is claimed is:

1. A password controlled anti-theft system for discouraging theft of a mutiple-component system in which at least one password controlled peripheral apparatus is connectable to a central apparatus, and wherein, when each of the central apparatus and the at least one peripheral apparatus enters into a burglary mode, the central apparatus and the at least one peripheral apparatus is inhibited from normal operation until a correct password is entered, the password controlled system comprising:

entry means in the central apparatus for entering a password, the central apparatus having means responsive to a peculiar password;

each of the at least one password controlled peripheral apparatus having a means for storing a peculiar password and being connected to and controlled by the central apparatus;

control means in said central apparatus for concurrently releasing the burglary modes of the central apparatus and the at least one password controlled peripheral apparatus connected thereto, when the peculiar passwords of the connected password controlled peripheral apparatuses as well as the peculiar password of the central apparatus are correctly entered via said entry means; and wherein, if no password controlled peripheral apparatus is connected to the central apparatus, entry of the peculiar password of the central apparatus causes said control means in said central apparatus to release the burglary mode of the central apparatus.

2. A password controlled system as recited in claim 1, wherein, the control means in said central apparatus includes means responsive to a predetermined order of passwords, to permit the peculiar password of the central apparatus to first be entered and the peculiar password of the at least one password controlled peripheral apparatus to be entered after the peculiar password of the central apparatus has been correctly entered.

3. A password controlled system as recited in claim 1, further comprising:

display means in the central apparatus for displaying an indication associated with an entry of a password.

4. A password conrolled anti-theft system for discouraging theft of a multi-component system in which at least one password controlled peripheral apparatus is connectable to a central apparatus and wherein, when each of the apparatuses enters into a burglary mode, the central apparatus and the at least one peripheral apparatus are inhibited from normal operation until a correct password is entered, the password controlled system comprising:

entry means in the central apparatus for entering a password;

first control means in said central apparatus for controlling the central apparatus, the first control means having means responsive to a peculiar password for the central apparatus;

each of the at least one password controlled peripheral apparatus respectively having second control means for controlling each of said at least one password controlled peripheral apparatus, each second control means having means for storing to a second peculiar password;

each of said at least one password controlled peripheral apparatus being connected to the central apparatus so that data is transmittable to and receivable from the central apparatus;

the central-apparatus first control means including means for reading the second peculiar password transmitted thereto by each of the at least one password controlled peripheral apparatus second control means, and means for collating an entry through the entry means of the central apparatus with each second peculiar password;

the central-apparatus first control means and each second control means of the at least one peripheral apparatus being responsive to entry of the peculiar passwords of the connected peripheral apparatuses as well as the entry of the peculiar password of the central apparatus for concurrently releasing the burglary modes of the central apparatus and each of the at least one peripheral apparatus connected to said central apparatus; and wherein, if no password controlled peripheral apparatus is connected to the central apparatus, entry of the peculiar password of the central apparatus causes said first control means of said central apparatus to release the burglary mode of the central apparatus.

5. A password controlled system as recited in claim 4, wherein the first control means in said central apparatus includes means responsive to a predetermined order of passwords to permit the peculiar password of the central apparatus to first be entered and the peculiar password of the at least one password controlled peripheral apparatus to then be entered after the peculiar password of the central apparatus has been correctly entered.

6. A password controlled system as recited in claim 5, wherein:

the first control means in the central apparatus includes means for transmitting data to the at least one peripheral apparatus;

the second control means in each of the at least one peripheral apparatus including means for transmitting acknowledge data, including an identification code identifying the respectively connected at least one peripheral apparatus, back to the first control means in the central-apparatus;

means in the first control means in the central apparatus for receiving said acknowledge data and for identifying a connected at least one password controlled peripheral apparatus; and said first control means in said central apparatus permitting entry of a password peculiar to the connected at least one password controlled peripheral apparatus when the identification code in the acknowledge data is correct.

7. A password controlled system as recited in claim 6, wherein the acknowledge data further comprises the password peculiar to the at least one connected password controlled peripheral apparatus.

8. A password controlled system as recited in claim 4, further comprising:

a burglary mode switch in the first control means of the central-apparatus for switching the operation of the central apparatus between a normal mode and a burglary mode.

9. A password controlled system as recited in claim 4, further comprising:

a burglary mode switch in the second control means of each of the at least one password controlled peripheral-apparatus for switching the operation of the at least one password controlled peripheral apparatus between a normal mode and a burglary mode.

10. A password controlled system as recited in claim 4, further comprising:

display means in the central apparatus for displaying an indication associated with an entry of a password.

11. A password controlled system for discouraging theft of a mutiple-component system in which at least one password controlled peripheral apparatus is connectable to a central apparatus and wherein, when each of the central apparatus and the at least one password controlled peripheral apparatus enters into a burglary mode, the central apparatus and the at least one password controlled peripheral apparatus is inhibited from normal operation until a correct password is entered, the password controlled system comprising:

entry means in said central apparatus for entering a password;

a first diode matrix in said central apparatus for setting a peculiar password;

first control means in said central apparatus;

each of the at least one password controlled peripheral apparatus having a seocnd diode matrix for setting a peculiar password;

the at least one password controlled peripheral apparatus being connected to transmit data to and received data from and be controlled by the central apparatus;

the first control means in the central-apparatus including reading means for reading the respective peculiar password set in the first diode matrix of the central-apparatus and the peculiar password set in the second diode matrix in each of said at least one password controlled peripheral apparatus and means for collating the respective passwords entered through the entry means with the peculiar passwords set in said matrices;

the first control means of the central-apparatus, upon correct entry of the peculiar passwords of the connected at least one password controlled peripheral apparatus as well as the peculiar password of the central apparatus, concurrently releasing the burglary modes of the central apparatus and the at least one peripheral apparatus connected to said central apparatus; and when no at least one password controlled peripheral apparatus is connected to the central apparatus, entry of the peculiar password of the central apparatus causes said first control means to release the burglary mode of the central apparatus.

12. A password controlled system as recited in claim 11, wherein, the first control means includes means responsive to a predetermined order of passwords to permit the peculiar password of the central apparatus to be entered first and the peculiar password of the at least one peripheral apparatus to then be entered after the peculiar password of the central apparatus has been correctly entered.

13. A password controlled system as recited in claim 12, wherein, when an entry of the peculiar password of the central apparatus is correct, the reading means in the first control means reads the peculiar password set in each second diode matrix of said at least one peripheral apparatus transmitted by the connected at least one peripheral apparatus to the central apparatus and the first control means permits entry of the peculiar password of the connected at least one peripheral apparatus through the entry means of the central apparatus.

14. A password controlled system as recited in claim 11, further comprising:

display means in the central apparatus for displaying an indication asssociated with an entry of a password.

* * * * *